US007500868B2

(12) United States Patent
Holland et al.

(10) Patent No.: US 7,500,868 B2
(45) Date of Patent: Mar. 10, 2009

(54) COMPRESSION CONNECTOR FOR STRANDED WIRE

(76) Inventors: Michael Holland, 107 Via Del Cielo, Santa Barbara, CA (US) 93109; Michael McCulley, 3134 W. Kuralt Ct., Anthem, AZ (US) 85086

( * ) Notice: Subject to any disclaimer, the term of this patent is extended or adjusted under 35 U.S.C. 154(b) by 0 days.

(21) Appl. No.: 11/796,091

(22) Filed: Apr. 25, 2007

(65) Prior Publication Data

US 2007/0259562 A1 Nov. 8, 2007

Related U.S. Application Data

(63) Continuation-in-part of application No. 11/591,690, filed on Nov. 1, 2006, now Pat. No. 7,364,462.

(60) Provisional application No. 60/854,321, filed on Oct. 24, 2006, provisional application No. 60/797,323, filed on May 2, 2006.

(51) Int. Cl.
*H01R 11/20* (2006.01)

(52) U.S. Cl. ..... 439/429; 439/427

(58) Field of Classification Search ..... 439/427–429
See application file for complete search history.

(56) References Cited

U.S. PATENT DOCUMENTS 1,381,779 A * 6/1921 Williams ..... 403/275
3,156,762 A * 11/1964 Matthysse ..... 174/87
3,397,382 A * 8/1968 Shannon ..... 439/429
3,492,630 A * 1/1970 Gerhard ..... 439/428
4,541,681 A * 9/1985 Dorman et al. ..... 439/429
4,561,179 A * 12/1985 Brush et al. ..... 29/866
4,576,430 A * 3/1986 Dufresne ..... 439/429
5,318,458 A * 6/1994 Thorner ..... 439/427
5,573,433 A * 11/1996 Lin et al. ..... 439/805
5,888,091 A * 3/1999 McQuilkin Murr ..... 439/427
5,899,777 A * 5/1999 Liang ..... 439/805
6,644,998 B2 * 11/2003 Kaufmann et al. ..... 439/412

* cited by examiner

*Primary Examiner*—Renee Luebke
*Assistant Examiner*—Larisa Tsukerman
(74) *Attorney, Agent, or Firm*—Laura Tunnell

(57) ABSTRACT

Compression-type connectors for attaching wires ranging in size from #10-16 and having stranded conductors. The connector is similar to coaxial cable connectors in that it includes a connector terminal adapter, a connector body attached to the connector terminal adapter, the connector body having an axial cavity dimensioned to receive a wire in a trailing end thereof, a centerpost disposed within the axial cavity that has a conical tip projecting rearwardly, and a compression sleeve slidably mounted either within the trailing end of the cavity or overlying the trailing end of the connector body. In one embodiment the centerpost is conical with the base of the cone disposed at the leading end of the cavity and the apex of the cone projecting rearwardly and a threaded outer surface therebetween. In a preferred embodiment, the centerpost has a straight threaded shaft with a conical tip. The connector terminal adapter is operable for attachment to a variety of conductive terminals.

4 Claims, 7 Drawing Sheets

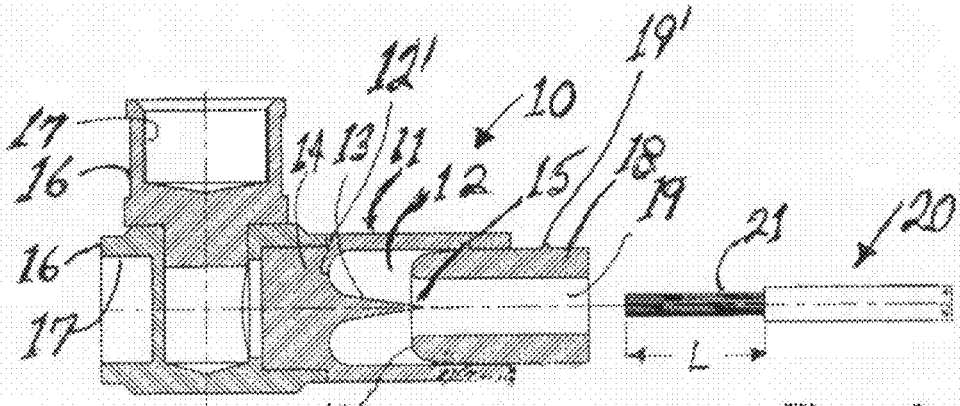
Figure 1
Figure 2
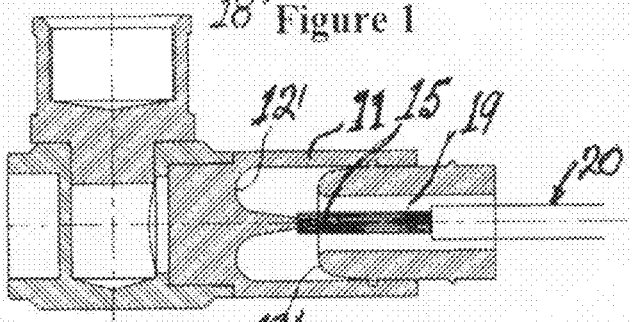
Figure 3
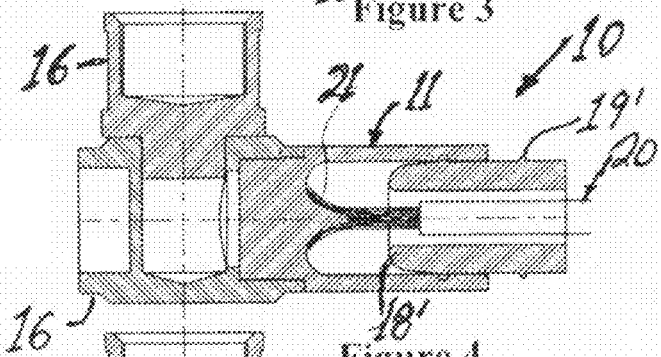
Figure 4
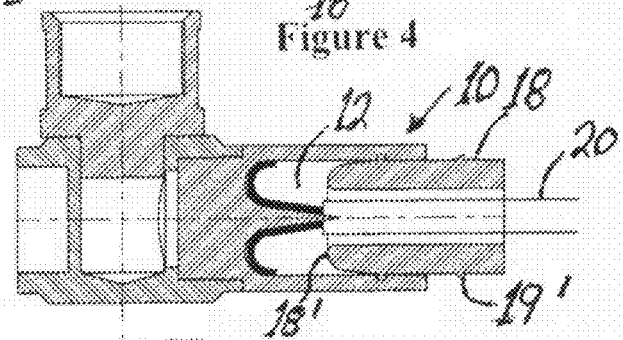
Figure 5
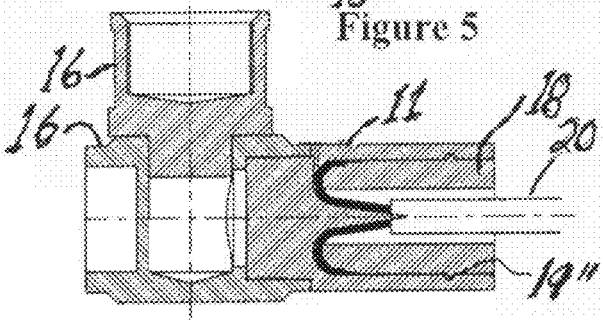
Figure 6

COMPRESSION CONNECTOR FOR STRANDED WIRE

CROSS REFERENCE TO RELATED APPLICATIONS

This application is a continuation-in-part of Nonprovisional Application U.S. Ser. No. 11/591,690, filed Nov. 1, 2006 now U.S. Pat. No. 7,364,462, which claims the benefit of U.S. Provisional Application Ser. Nos. 60/797,323, filed May 2, 2006, and 60/854,321, filed Oct. 24, 2006.

BACKGROUND OF THE INVENTION

1. Field of the Invention

The present invention relates to a compression connector for use with electrically conductive wires having a stranded center conductor.

2. Prior Art

A variety of methods are currently employed for attaching the stranded center conductor of a wire to a terminal. Most methods require that a portion of the jacket covering of the wire be stripped to expose a portion of the stranded conductor. The stripped portion of the wire is then inserted into the hollow sleeve of a connector such as a spade lug and radial pressure is applied to the sleeve with a crimping tool to prevent longitudinal force from pulling the wire from the connector. This is similar to the standard crimp type connections used on cars, boats and trailers. The limitation in these designs is that a stranded wire conductor has spaces between strands, even after compression. Over time, such spaces between strands can be easily reduced after compression, such as by vibration or corrosion, which reduces the outer diameter of the stripped, crimped portion of the wire. The strands of the wire will move to fill the void resulting in the initial crimp or radial force originally applied to hold the wire being inadequate to continue to securely hold the wire.

Holliday, in U.S. Patent Application Publication No. 2005/0159041 discloses a fitting which is adapted for connecting a stripped end of an electrically conductive wire to another electrically conductive member. The fitting includes an adapter having a hollow, generally cylindrical body which is open at one end, an internally threaded wall portion in the body which is dimensioned to receive and to threadingly engage the stripped end of the wire, a connector body including a connector sleeve into which the adapter is inserted, and means for crimping the adapter into positive engagement with the wire. A plurality of adapters are provided for each connector assembly in which the internally threaded wall portions are sized to match up with a different gauge wire but wherein the outer diameters of the adapters are the same in order to use the same or consistent size connector body for the different gauge wires. The adapters are further characterized by being slotted to form arcuate segments at the entrance end of the adapter for insertion of the wire, the slots being dimensioned to limit the inward radial contraction of the segments into clamping engagement with the end of the wire. A problem with this fitting is that it requires a separate loose cap for the assembly that can be easily lost. In addition, different sizes of wire require a separate adapter requiring identification. A further disadvantage in this type of fitting is that if the strands of wire comprising the conductor undergo corrosion, tension on the wire may cause the stripped portion to pull out of the adapter and, accordingly, the fitting. This disengagement can happen because the trapped strands of wire are parallel to both the axis of the adapter and the direction of the unstripped portion of wire.

Korte et al., in U.S. Pat. No. 6,857,895, disclose an electrical connector for coupling to a multi-stranded conductor. The electrical connector can be used for coupling to an insulated multi-stranded conductor. The connector includes a housing having at least one bore for receiving an insulated multi-stranded electrical conductor; an electrically conductive prong located in the bore and electrically connected to the housing; and a securing means for insertion into the bore after insertion of the electrical conductor into the bore and onto the prong. Insertion of the securing means into the bore, after insertion of the electrical conductor into the bore and onto the prong, presses the strands of the electrical conductor against the conductive prong such that the connector makes electrical contact with the electrical conductor and acts to mechanically secure the electrical conductor to the connector. A limitation and disadvantage of the connector of Korte et al. is that the prong is funnel-shaped and when lateral pressure is exerted on the cable jacket during the compression step, the lateral forces (directed radially inwardly) tend to force the stranded wire rearwardly (i.e., off of the prong) due to the conical shape of the prong, and rearward tension on the cable may separate the cable from the connector.

In the connector of Korte et al., the unstripped cable is pushed onto a smooth prong whose diameter changes with a sloped design. As a rear plug is moved inwardly to lock the cable into the connector, the space between the fixed outer shell and the sloped center prong is reduced by the addition of a wedge-type action of the plug. The limitations of this design further include the need to assure the wire is pushed forward sufficiently onto the sloped prong to result in the required holding force, the stranded wire slipping rearwardly off of the smooth surface of the prong as the connector is being handled and compressed, and that the strands remain in the same plane as the pulling force. The holding power relies on wire being inserted to the correct depth as well as the exact sizing of the plug and body to a limited size of wire. In addition, the insertion of the rear plug must be complete to effect the designed holding and whose forward motion could be limited by the stranded wire not aligning directly onto the prong and sitting on one side. This would not allow the plug to be fully inserted.

In view of the aforementioned limitations of the prior art stranded conductive wire cable connectors, it would be an advance in the art to provide a one-piece compression-type connector for a wire having a stranded conductor wherein the trapped strands of wire resist separation from the fitting when tension is applied to the wire, even when the strands are corroded.

SUMMARY

The present invention is directed to a compression-type connector for a wire having a stranded central conductor. The wire is affixed to the connector using the same method and tool used when installing a compression-type connector on the prepared end of a coaxial cable having a nonstranded center conductor. The structure of the connector substantially obviates one or more of the limitations of the related art. To achieve these and other advantages, and in accordance with the purpose of the invention as embodied and broadly described herein, the connector includes a threaded connector terminal adapter and a connector body attached to the connector terminal adapter and in electrical communication with the connector terminal adapter. The connector body is a tubular member having a leading end and a trailing end and a cylindrical axial cavity in the trailing end thereof. The surface of the axial cavity may be smooth or optionally threaded or similarly roughened (e.g., skived) to grip the stranded conductor. A conical centerpost having a circular base and a sharp apex is axially disposed within the axial cavity at the leading end thereof (i.e., the end of the connector body adjacent the connector terminal adapter) such that the base of the conical centerpost is disposed at the leading end of the cavity and in electrical contact with the connector body, and the apex of the conical centerpost is centered within the axial cavity and projects rearwardly from the base (i.e., the apex of the conical centerpost projects away from the leading end of the connector body toward the trailing end thereof). The outer surface of the conical centerpost may have a spiral thread thereon that performs two functions: (a) the thread enables an installer to twist the end of the wire into the axial cavity of the connector body until resistance to further advancement indicates that the wire is fully inserted into the axial cavity; and (b) the threaded outer surface of the conical centerpost grips the conductive strands within the cable and provide additional resistance to prevent the strands from slipping off of the conical centerpost during compression or when tension is applied to the cable. A compression sleeve having an axial bore is slidably mounted within the axial cavity of the connector body.

In a first embodiment, the compression-type connector comprises a connector body, a connector terminal adapter at the leading end of the connector body and a compression sleeve slidably mounted within an axial cavity in the trailing end of the connector body. The connector terminal adapter is preferably a threaded member operable for receiving and engaging a suitable matingly-threaded connector terminus. The connector body is a tubular, electrically conductive member having a leading end, a trailing end and a cylindrical axial cavity in the trailing end thereof. The leading end of the cavity has a hemitoroidal shape and an open trailing end. The aforesaid connector terminal adapter is attached to the leading end of the connector body and in electrical communication therewith. A conical centerpost having a circular base is concentrically disposed in the leading end of the axial cavity. The apex of the conical centerpost is in opposition to the base of the conical centerpost and is axially disposed within the axial cavity and projects rearwardly from the base toward the open trailing end of the cavity. A compression sleeve having a curved leading end contoured to mate with curved, hemitoroidal shape of the leading end of the cavity and an axial bore coextensive with the length of the compression sleeve is slidingly mounted within the trailing end of the axial cavity. The axial bore of the compression sleeve is dimensioned to enable passage of a wire to which the connector is to be connected therethrough. The conical centerpost has an outer surface which optionally may have a spiral thread thereon.

In operation, in the above-described first embodiment of the present connector, the stripped end of a cable having a stranded central conductor is inserted into the trailing end of the axial bore in the compression sleeve and forced into the axial cavity within the connector body toward the contoured leading end thereof (while twisting the wire if the conical centerpost is threaded). As the cable is advanced, the stranded conductor is separated and splayed in 360 degrees when forced against the apex of the conical centerpost. Further advancement of the wire into the axial cavity causes the strands of wire to bend outwardly at the forward end thereof as they encounter the curved leading end of the axial cavity in the connector body. The compression sleeve is then advanced into the axial cavity to trap and securely hold the forwardmost ends of the strands between the curved leading end of the axial cavity and the matingly curved leading end of the compression sleeve. When the compression sleeve is fully advanced within the axial cavity in the connector body, a detent on the outer surface of the compression sleeve engages a mating detent on the wall of the axial cavity and locks the compression sleeve in position to prevent retraction thereof. Since the trapped forward ends of the strands comprising the center conductor are recurved, the strands resist disengagement from the connector when tension is applied to the wire, even when the connector is exposed to vibration and/or the strands are corroded. A desired terminus such as a spade lug or banana plug is then screwed onto the connector terminal adapter to complete the assembly.

In a preferred embodiment of a compression-type connector operable for attachment to a wire having a stranded center conductor and an outer jacket, the connector comprises a connector body and a compression sleeve slidably mounted over a trailing end of the connector body. The connector body has a leading end, a tubular deformable trailing end and a cylindrical axial cavity in the trailing end. The leading end of the connector body is a connector terminal adapter operable for removably receiving an electrically conductive connector terminal. The connector body further includes an electrically conductive centerpost comprising a threaded shaft having a fixed leading end and a free trailing end. The fixed leading end of the shaft is attached to the leading end of the axial cavity. The free opposing (i.e., trailing) end of the shaft has a conical tip coaxially centered in the cavity and projecting rearwardly toward the open trailing end of the axial cavity. The compression sleeve has a length and a tapered axial bore coextensive with the length. The compression sleeve is slidably mounted over the tubular deformable trailing end of the connector body. The tapered axial bore of the compression sleeve is dimensioned to slidably accommodate the trailing end of the connector body therewithin.

In operation of the preferred embodiment, the end of a cable having a stranded conductor is inserted into the trailing end of the axial bore of the compression sleeve and advanced therethrough and into the axial conduit of the connector body. As the cable is advanced into the axial cavity, the stranded conductor is separated and splayed in 360 degrees when forced against the apex of the conical centerpost. In the preferred embodiment, the leading end of the axial conduit is not curved. Accordingly, when the cable is fully advanced into the connector body by twisting and forward pressure on the wire, the leading ends of the splayed stranded conductor are not recurved as with the first embodiment. A further advantage of the preferred embodiment is that an installer can be relatively certain that the wire is fully advanced into the axial cavity and that the leading end of the wire abuts the base of the threaded shaft because further twisting and pressure do not advance the wire into the cavity. The compression sleeve is then advanced over the trailing end of the connector body to force the connector body, which may be slotted to facilitate compression, radially inwardly, compressing the strands of wire between the threaded outer surface of the shaft and the inner surface of the axial conduit in the connector body. Due to the thread on the outer surface of the shaft, the compression is operable for securely holding the entrapped and compressed strands of wire between the wall of the axial conduit and the centerpost. When the compression sleeve is fully advanced over the connector body, an optional detent on the inner surface of the axial bore of the compression sleeve engages a mating detent on the outer surface of the connector body and locks the compression sleeve in position to prevent retraction thereof. The surface of the axial cavity and the spiral thread on the outer surface of the centerpost between which the strands are entrapped prevent the wire from being pulled from the connector when tension is applied thereto.

The features of the invention believed to be novel are set forth with particularity in the appended claims. However the invention itself, both as to organization and method of operation, together with further objects and advantages thereof may be best understood by reference to the following description taken in conjunction with the accompanying drawings.

BRIEF DESCRIPTION OF THE DRAWINGS

FIG. 1 is a side cross-sectional view of a compression-type connector for a wire having a stranded central conductor in accordance with a first embodiment of the present invention prior to inserting a wire into the axial bore in the compression sleeve (for clarity, the connector terminal, which is threadingly attached to the connector terminal adapter, is not shown in FIG. 1 and FIGS. 2-10 that illustrate various embodiments of the present connector).

FIG. 2 shows a wire having a stranded central conductor with an end of the wire stripped to expose a length of the stranded central conductor.

FIG. 3 is a side cross-sectional view of a compression-type connector of FIG. 1 illustrating the insertion of the prepared end of the wire of FIG. 2 into the axial bore in the compression sleeve.

FIG. 4 is a side cross-sectional view of the compression-type connector of FIG. 3 showing the splaying of the strands of wire comprising the central conductor by the conical centerpost when the prepared end of the wire is further advanced into the axial bore in the compression sleeve and into the axial cavity in the connector body.

FIG. 5 is a side cross-sectional view of the compression-type connector of FIG. 4 showing the splaying and lateral separation of the strands of wire comprising the central conductor by the conical centerpost when the prepared end of the wire is yet further advanced into the axial cavity in the connector body.

FIG. 6 is a side cross-sectional view of the compression-type connector of FIG. 4 showing the splaying and lateral separation of the strands of wire comprising the central conductor by the conical centerpost when the prepared end of the wire is fully advanced into the axial cavity in the connector body and the compression sleeve advanced into the axial cavity in the body of the connector and in locking engagement therewith.

DESCRIPTION OF THE PREFERRED EMBODIMENTS

Figure 7:
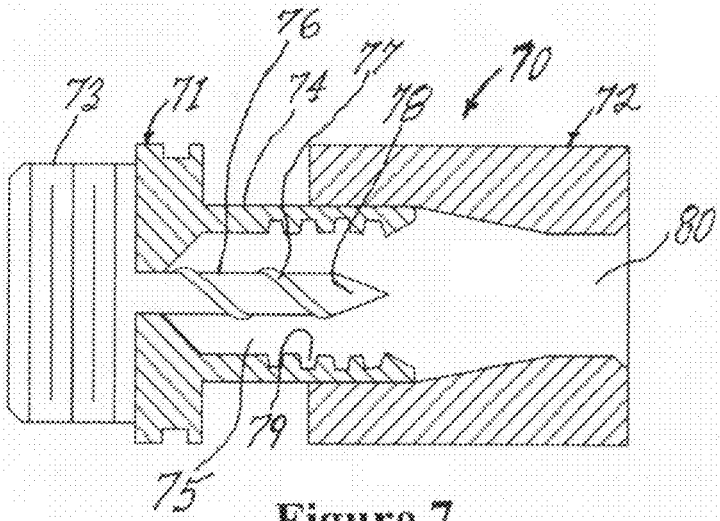
FIG. 7 is a partially cross-sectional view of a compression-type connector in accordance with a preferred embodiment of the present invention.

FIG. 1 is a compression-type connector 10 operable for attachment to a wire having a stranded central conductor in accordance with a first embodiment of the present invention. The connector 10 is illustrated in cross-sectional side view in an open position prior to attachment to a wire. The connector 10 includes a tubular connector body 11 having an axial cavity 12 therewithin. The leading end 12' of the axial cavity 12 is contoured and has the form of the surface of a hemitorus. A conical centerpost 13 is disposed within the axial cavity 12 at the leading end thereof. The base 14 of the conical centerpost 13 is circular and centered within the leading end 12' of axial cavity 12. The apex 15 of the conical centerpost is axially disposed to be colinear with the axis of the axial cavity. The leading end of the connector body 11 is attached to at least one, and more preferably two, as shown in the figures, connector terminal adapter 16 having a threaded interior surface 17. The connector terminal adapter(s) 16 provide means for connecting an electrically conductive terminus such as a lug, pin or the like, the terminus having a threaded base portion similar to the termini shown in FIGS. 11-13, to the compression-type connector 10. A compression sleeve 18 having a leading end 18', which may or may not be contoured, and an axial bore 19 is slidingly mounted within the axial cavity 12 and held therewithin by detent 19'.

FIG. 2 shows a wire 20, such as, for example, a speaker wire, having a stranded central conductor 21 with an end of the wire 20 being stripped to expose a length L of the stranded central conductor 21. FIG. 3 is an elevational cross-sectional view of the compression-type connector of FIG. 1 illustrating the insertion of the prepared end 21 of the wire 20 of FIG. 2 into the axial bore 19 in the compression sleeve until the leading end of the stranded center conductor 21 makes contact with the apex 15 of the conical centerpost 13. As the wire is further advanced through the axial bore 19 and into the axial cavity 12, the strands of wire comprising the central conductor 21 are splayed, being forced radially outwardly by the conical centerpost 13 as shown in FIG. 4. FIG. 5 shows the further splaying and lateral separation of the strands of wire comprising the central conductor 21 by the conical centerpost 13 when the prepared end of the wire is yet further advanced through the axial bore 19 of the compression sleeve 18 until the stripped length L of the wire 20 has been separated by the conical centerpost. When the wire 20 is fully advanced through the axial bore 19 in the compression sleeve 18 and into the axial cavity 12 of the connector body, the forwardmost ends of the strands comprising the center conductor are forced to curve and bend rearwardly in the axial cavity 12 of the body 11 by the contoured leading end 12' of the axial cavity 12.

When the wire is fully advanced into the axial cavity 12, as shown in FIG. 5, a compression tool (not shown) is employed to force the compression sleeve 15 forwardly within the axial cavity 12 toward the leading end 12' thereof as shown in FIG. 6. When the compression sleeve 18 is fully advanced, the leading end 18' of the compression sleeve 18 is urged against the bent strands of wire 21 comprising the central conductor, trapping the strands of wire 21 between the leading end 18' of the compression sleeve 18 and the connector body 11. A second detent 19" engages a mating detent rest in the wall of the axial cavity causing locking engagement therewith. After the wire 20 is securely attached to the connector 10 in the manner described above, a suitable electrically conductive terminus such as a spade lug or banana plug having a threaded portion can be attached to either of the connector terminal adapter(s) 16. The assembly provides secure attachment between the connector terminus and the wire.

A key feature of the first embodiment of the connector of the present invention presented above is the curvature of the leading end of the axial cavity. During advancement of the wire 20, the splayed strands of wire 21 bend outwardly and follow the curved path established by the hemitoroidal surface at the leading end of the axial conduit. When the compression sleeve is fully advanced, the leading end 18' of the compression sleeve, which can be flat or have a toroidal shape that mates with the curvature of the leading end of the axial cavity 12, traps the recurved ends of the stranded wire against the connector body such that the strands of wire are perpendicular to the axis of the axial bore of the compression sleeve at the forwardmost portion of the wire strands. The wire/connector assembly thus formed resist separation of the wire from the connector (and the selected terminus) when tension is applied to the wire.

Figure 17:
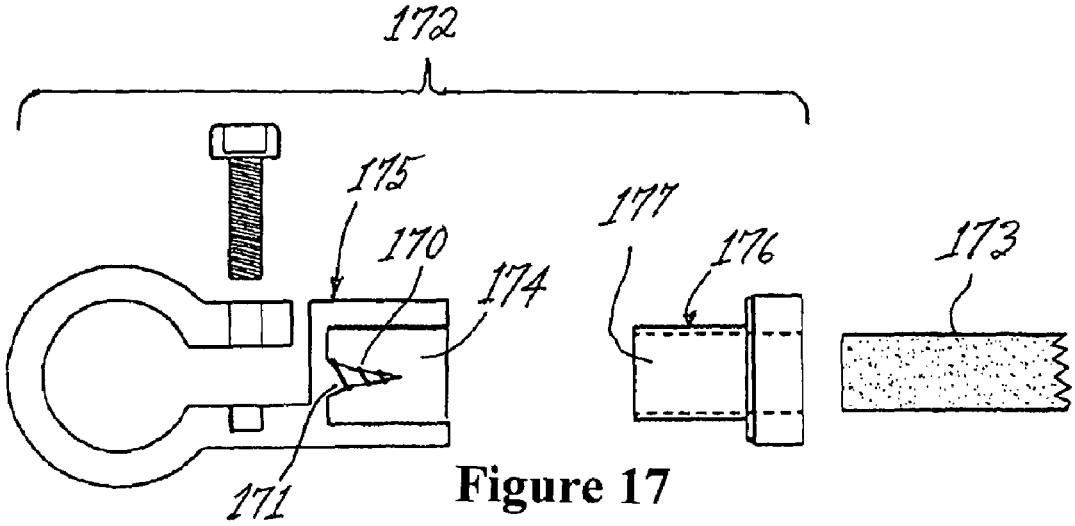
FIG. 17 is a cross-sectional view of an improvement to a compression connector in accordance with the prior art wherein the connector is improved by the inclusion of a spiral ridge or thread on the outer surface of the centerpost to enhance the wire-gripping strength of the connector following compression, and providing means for an installer to determine when the end of a wire is fully inserted within the axial cavity of the connector body.
Figure 18:
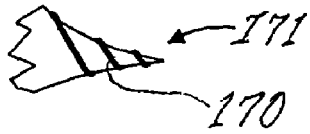
FIG. 18 is an enlarged view of a portion of the threaded conical centerpost on the connector of FIG. 17.

A disadvantage of prior art stranded wire connectors such as disclosed by Korte et al. '895 is that after compression, the connector is easily removed from the wire by the application of axially directed tension on the wire. This disadvantage is due to the absence of a positive wire strand-gripping mechanism in the connector. All surfaces holding the wire within the prior art connectors are smooth and provide only minimal gripping. As will be illustrated later, when FIGS. 17 and 18 are discussed, the present invention also includes a modification of the prior art stranded wire connector disclosed in Korte et al. '895 that improves the gripping force of the connector. Notwithstanding the aforesaid improvement in Korte et al '895 that will be discussed later, a more preferred embodiment of a stranded wire connector that overcomes the problem of secure attachment inherent in the prior art connectors is presented below.

Turning now to FIG. 7, a preferred embodiment of the stranded wire connector of the present invention is illustrated in partially cross-sectional view at 70. The connector 70 comprises a connector body 71 and a compression sleeve 72. The connector body 71 has a threaded leading end 73 integral therewith, and a tubular trailing end 74 having a cylindrical cavity 75 therewithin. A rigid centerpost 76 projects rearwardly from the leading end of the cylindrical cavity 75 and is centered within and coaxial with the cylindrical cavity 75. The centerpost 76 has a straight spiral-threaded shaft 77 and a conical tip 78 on the trailing end thereof. The tubular trailing end 74 of the connector body 71, which may have longitudinal slots in the wall thereof to facilitate deformation of the trailing end 74 radially inwardly during compression, preferably has a roughened inner surface 79 such as one or more annular ridges operable for capturing and holding a wire (20 in FIG. 2) after compression as will be discussed below. The compression sleeve 72, which is slidably mounted over the trailing end 74 of the connector body 71, has a rearwardly-tapered axial bore 80. That is, the inner diameter of the axial bore at the leading end of the compression sleeve is greater than the diameter of the axial bore at the trailing end of the compression sleeve.

Figure 8:
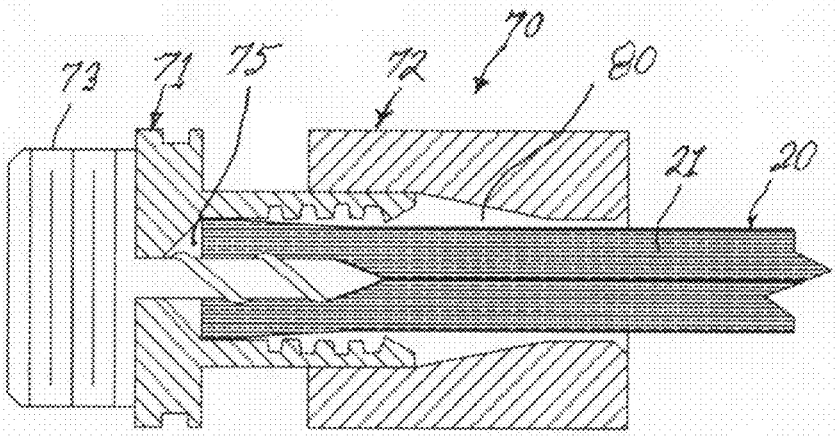
FIG. 8 is a partially cross-sectional view of a compression-type connector in accordance with the preferred embodiment of the present invention illustrated in FIG. 7 with the end of a cable inserted thereinto before compression.
Figure 9:
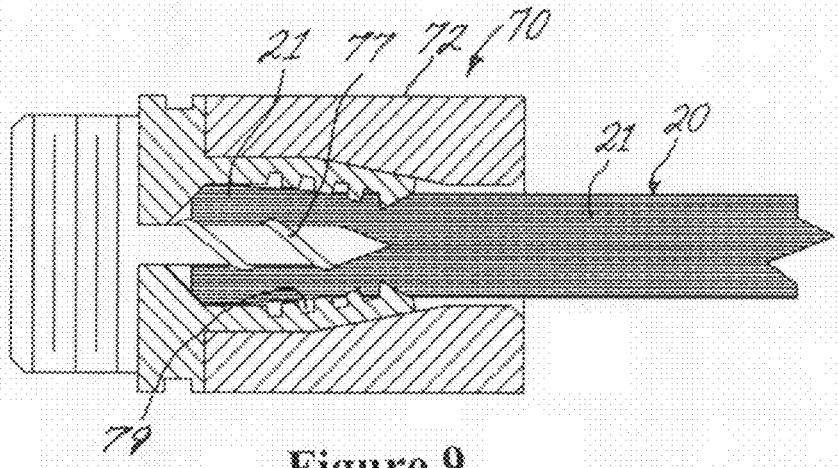
FIG. 9 is a partially cross-sectional view of the compression-type connector in accordance with FIGS. 7 and 8 illustrating the secure holding of the cable by the connector when the compression sleeve is advanced over the trailing end of the connector body.

The installation of the connector 70 onto the end of a wire having a stranded conductor is illustrated in FIGS. 8 and 9. FIG. 8 is a partially cross-sectional view of the compression-type connector 70 in accordance with the preferred embodiment of the present invention illustrated in FIG. 7, with the end 21 of a wire 20 having a stranded center conductor inserted through the axial bore 80 of the compression sleeve 72 and into the axial cavity 75 in the trailing end of the connector body 72. As the conductive strands of wire 21 are forced in a forward direction (i.e., toward the leading end of the axial cavity 75) by application of a forward twisting force, the strands encounter the conical tip 78 of centerpost 76 and are separated and forced radially outwardly, stretching the outer jacket of the wire. When the wire 20 is fully advanced and the tips of the wire strands are abutting the leading end of the cavity 75, the compression sleeve is advanced over the trailing end 74 of the connector body 71 by means of a compression tool (not shown) or by threaded engagement between the outer surface of the trailing end of the connector body and the inner surface of the compression sleeve. As the compression sleeve advances toward the leading end of the connector body, the connector body is deformed radially inwardly by the tapered axial bore 80 in the compression sleeve 72 to compress the strands of wire 21 between the roughened wall of the axial cavity 75 and the threaded exterior surface of the centerpost.

Figure 10:
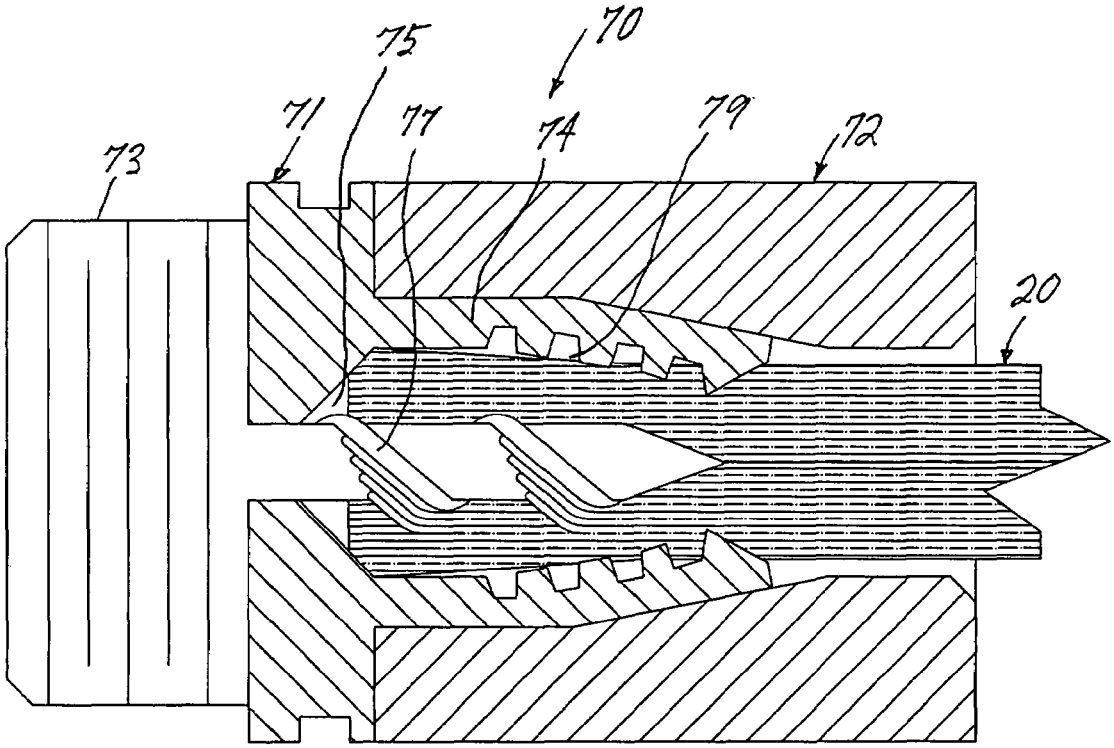
FIG. 10 is an enlarged view of the cable and connector of FIG. 9 when compression is completed by the full advancement of the compression sleeve over the connector body.

FIG. 9 is a partially cross-sectional view of a compression-type connector in accordance with FIGS. 7 and 8 illustrating the secure holding of the cable by the connector when the compression sleeve is fully advanced over the trailing end of the connector body. FIG. 10 is an enlarged view of the wire and connector assembly of FIG. 9 when compression is completed by the full advancement of the compression sleeve over the connector body. The tapered axial bore 80 of the compression sleeve 72 forces the trailing end 74 of the connector body 71 inwardly such that the splayed wire 21 is trapped between the roughened inner surface 79 of the cavity 75 and the threaded shaft 77 of the centerpost 76. The spiral thread 77 on the shaft of the centerpost 76 and the surface 79 of the cavity 75, which may optionally have one or more annular ridges on the surface thereof to increase holding force, serve to provide compression points through 360 degrees and provide additional resistance to the retraction of the wire 20 from the connector 70 after compression is complete.

Figure 11:
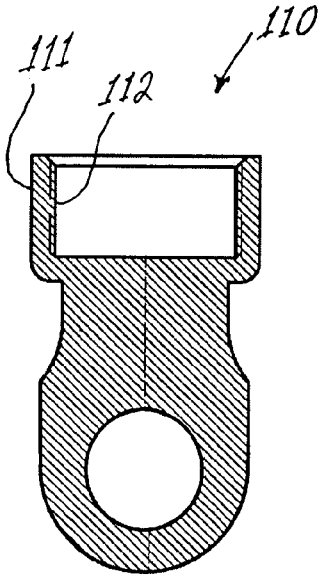
FIG. 11 is a top view of a standard terminal connector of the type used with a threaded bolt wherein the trailing end has a threaded bore adapted to matingly receive the threaded connector terminal adapter on the leading end of a connector in accordance with all foregoing embodiments of the present connector.
Figure 12:
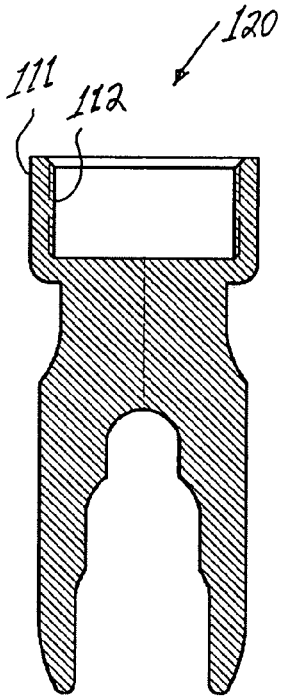
FIG. 12 is a top view of a spade lug adapted to be threadably attached to a connector in accordance with the present invention.
Figure 13:
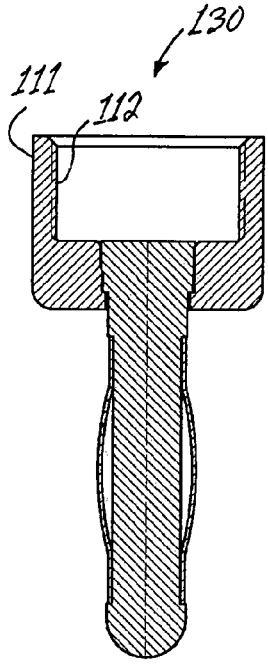
FIG. 13 is a top view of a banana plug adapted to be threadably attached to the connector terminal adapter on the leading end of any of the stranded wire connectors of the present invention.
Figure 14:
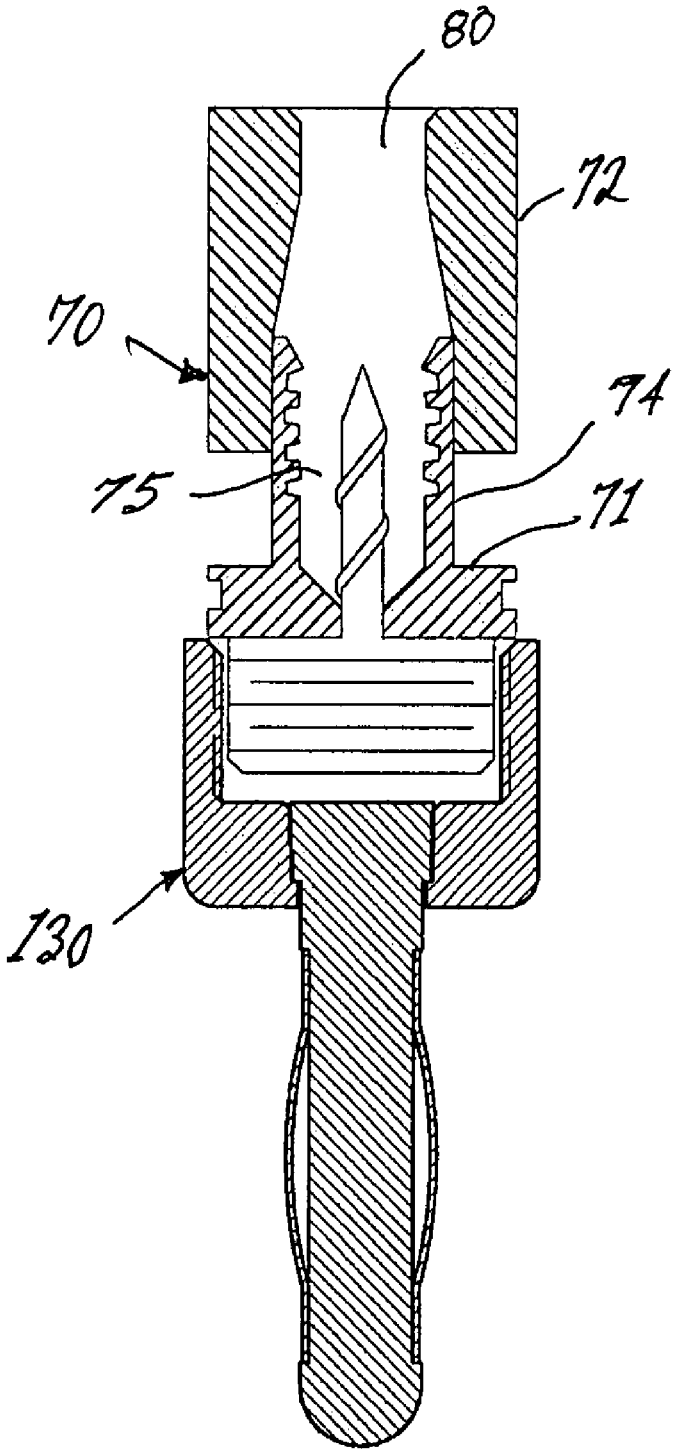
FIG. 14 is an enlarged cross-sectional view of the banana plug terminus of FIG. 13 showing the banana plug terminus attached to the preferred embodiment of the stranded wire connector illustrated in FIGS. 7-10.

It is an important feature of the connector of the present invention that it be adaptable for use with a variety of mating connector terminal receptacles. FIGS. 11-13 illustrate a variety of conductive connector terminals adapted to be removably attached to the connector 70. FIG. 11 is a top view of a standard terminal connector 110 of the type used with a threaded bolt-type mating terminal receptacle. The trailing end 111 of terminal 110 has a threaded bore 112 adapted to matingly receive the threaded connector terminal adapter 73 on the leading end of connector 70. FIG. 12 is a top view of a spade lug 120 adapted to be removably attached to the threaded leading end 73 of connector 70. FIG. 13 is a top view of a banana plug 130 adapted to be threadably and removably attached to the leading end of connector 70. FIG. 14 is an enlarged cross-sectional view of the banana plug terminus of FIG. 13 showing the banana plug terminus 130 attached to the preferred embodiment of the stranded wire connector 70 illustrated in FIGS. 7-10.

Figure 15:
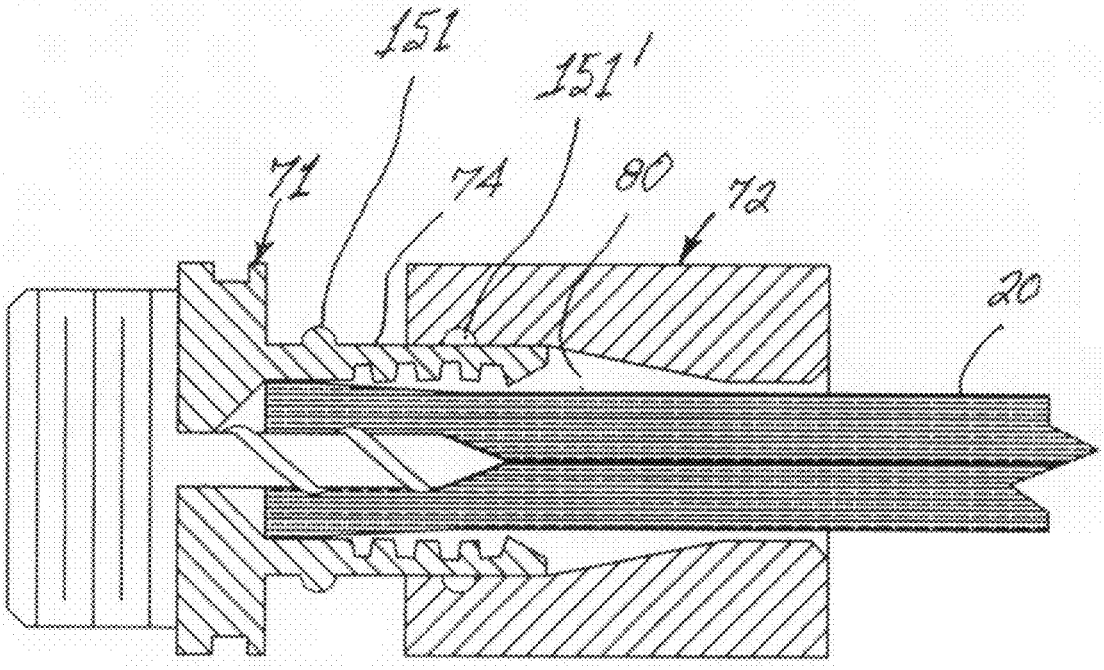
FIG. 15 is a partially cross-sectional view of a compression-type connector in accordance with the preferred embodiment of the present invention illustrated in FIG. 7 with a cable inserted thereinto before compression wherein the connector comprises locking means operable for impeding the retraction of the compression sleeve after compression is complete.
Figure 16:
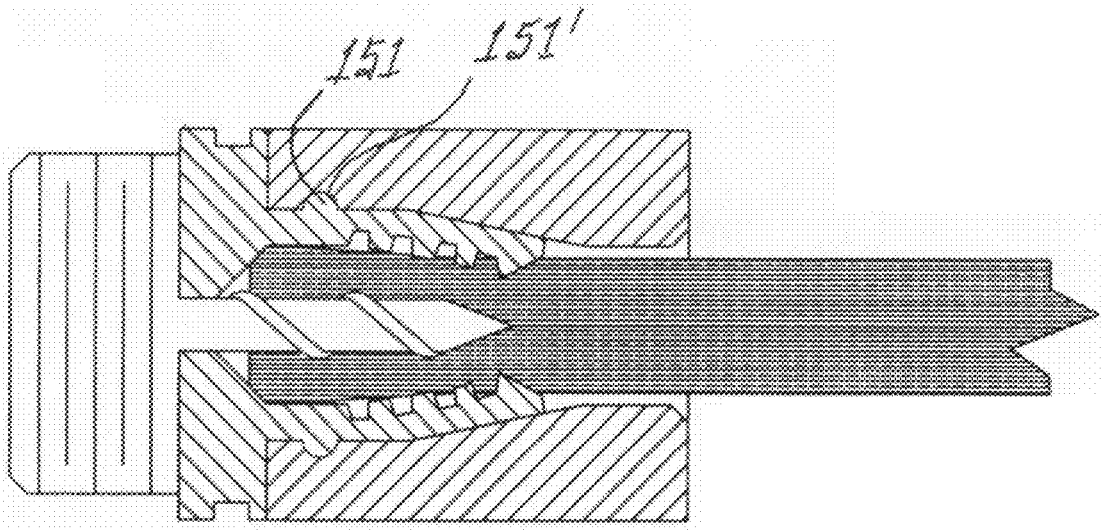
FIG. 16 is a partially cross-sectional view of a compression-type connector in accordance with FIG. 15 illustrating the secure holding of the cable by the connector when the compression sleeve is advanced over the trailing end of the connector body and the locking means is engaged subsequent to compression.

It may be desirable to provide the connector 70 with locking means operable for preventing or impeding removal of the compression sleeve 72 from the connector body 71 when compression is complete. A modification of the preferred embodiment of connector 70 including such locking means is shown in FIGS. 15 and 16. FIG. 15 is a partially cross-sectional view of a compression-type connector in accordance with the preferred embodiment of the connector 70 with a cable inserted thereinto before compression wherein the connector comprises locking means 151 and 151' operable for impeding or resisting the retraction of the compression sleeve from the connector body after compression is complete. In the example shown in FIGS. 15 and 16, the locking means 151 and 151' are an annular ridge on the outer surface of the trailing end of the connector body and an annular groove on the inner surface of the axial bore of the compression sleeve respectively. FIG. 16 is a partially cross-sectional view of the compression-type connector in accordance with FIG. 15 illustrating the secure holding of the cable by the connector when the compression sleeve is advanced over the trailing end of the connector body and the locking means 151 and 151' is engaged subsequent to compression.

As discussed above, in the connector of Korte et al. '895, the unstripped cable is pushed onto a smooth conical prong. As a rear plug (i.e., compression sleeve) is moved inwardly to lock the cable into the connector, the annular space between the wall of the axial cavity and the conically-tapered center prong is reduced by the addition of a wedge-type action of the plug. The limitations of this design it is necessary for the installer to assure that the wire is pushed forward sufficiently onto the conical prong to result in the required holding force because the stranded wire has a tendency to slip rearwardly off of the smooth surface of the prong as the connector is being handled and compressed, and because the wire strands remain in the same plane as the pulling force. The holding power relies on the wire being inserted to the correct depth into the axial cavity as well as the exact sizing of the plug and body to a limited size of wire.

An improvement in the connector of Korte et al. '895 that overcomes these limitations is illustrated in FIGS. 17 and 18. FIG. 17 is a cross-sectional view of an improvement to the compression connector 172 of Korte et al. '895 wherein the connector 172 is improved by the inclusion of a spiral ridge or thread 170 on the outer surface of the centerpost 171 to enhance the wire-gripping strength of the connector following compression, and providing means for an installer to determine when the end of a wire 173 is fully inserted within the axial cavity 174 of the connector body 175. FIG. 18 is an enlarged view of a portion of the threaded conical centerpost 171 on the connector 172 of FIG. 17. If the connector body 175 is made to be deformable radially inwardly, as, for example, by the inclusion of a plurality of longitudinal slots in the wall thereof in the manner well known in the art, the compression sleeve 176 can be slidably mounted over the trailing end of the connector body 175 by enlarging the leading end of the axial bore 177 in the compression sleeve. If the axial bore is tapered, advancement of the compression sleeve 176 over the connector body 175 toward the leading end thereof will force the wall of the axial cavity 174 radially inwardly during compression to clamp the end of the wire 173 between the threaded prong and the wall of the axial cavity.

While particular embodiments of the present invention have been illustrated and described, it would be obvious to those skilled in the art that various other changes and modifications can be made without departing from the spirit and scope of the invention. For example, the connector terminal adapter on the leading end of the connector body may be either a threaded male or a threaded female fitting, depending on the mating attachment means presented on the conductive terminal to which the connector body is to be attached. Further, it will be obvious to the artisan that the inclusion of a detent between the connector body and the compression sleeve of all the connectors disclosed herein will resist and/or prevent the removal of the compression sleeve from the connector body after compression is complete. Similarly, the artisan will appreciate that one or more annular ridges on the wall of the axial cavity will improve the wire-holding force of the connector and further resist separation of the end of the wire from the connector. It is therefore intended to cover in the appended claims all such changes and modifications that are within the scope of this invention.

What we claim is:

1. A compression-type connector operable for attachment to a wire having a stranded center conductor and an electrically insulating outer jacket, the connector comprising: (a) a connector body having a leading end, a tubular deformable trailing end and a cylindrical axial cavity in said trailing end, said leading end of said connector body having a connector terminal adapter thereon operable for removably receiving an electrically conductive connector terminal; (b) an electrically conductive centerpost comprising a threaded shaft having a leading end attached to said leading end of said axial cavity, and a conical tip at a trailing end thereof, said conical tip being disposed coaxially within said cylindrical cavity; and (c) a compression sleeve having a length and a tapered axial bore coextensive with said length, said compression sleeve being slidably mounted over said tubular deformable trailing end of said connector body.

2. The compression-type connector of claim 1 wherein said connector further comprises a conductive connector terminal releasably attached to said connector terminal adapter.

3. The compression-type connector of claim 1 wherein said tubular deformable trailing end of said connector body has at least one longitudinal slot therein.

4. The compression-type connector of claim 3 wherein said connector further comprises a conductive connector terminal releasably attached to said connector terminal adapter.

* * * * *